US006462764B1

(12) United States Patent
Kubelik

(10) Patent No.: US 6,462,764 B1
(45) Date of Patent: Oct. 8, 2002

(54) PRINTHEAD WITH REDUNDANT ELECTRODES

(75) Inventor: Igor Kubelik, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/802,403

(22) Filed: Mar. 9, 2001

(51) Int. Cl.[7] ..... B41J 2/415
(52) U.S. Cl. ..... 347/127; 347/123; 399/135
(58) Field of Search ..... 347/123, 127, 347/120; 399/135

(56) References Cited

U.S. PATENT DOCUMENTS 4,494,129 A * 1/1985 Gretchev ..... 347/127
4,999,653 A * 3/1991 McCallum ..... 347/127
5,006,869 A * 4/1991 Buchan et al. ..... 347/127
5,278,588 A 1/1994 Kubelik ..... 347/127
5,886,723 A 3/1999 Kubelik et al. ..... 347/120
6,061,074 A * 5/2000 Bartha et al. ..... 347/123

* cited by examiner

*Primary Examiner*—Susan S. Y. Lee
(74) *Attorney, Agent, or Firm*—Fay, Sharpe, Fagan, Minnich & McKee, LLP

(57) ABSTRACT

A printhead having a set of redundant rows of electrodes. The set of redundant rows is formed by providing additional rows of a first set of electrodes that repeats the charge-deposition pattern of another electrode in the set. The redundant electrodes are selectively activated to allow line to line variation of the charge deposition sequence when forming a latent image.

19 Claims, 5 Drawing Sheets

PRINTHEAD WITH REDUNDANT ELECTRODES

BACKGROUND OF THE INVENTION

The present invention relates to charge deposition printheads suitable for use in image forming systems. More particularly, the invention relates to printheads having selectively controlled electrodes, generally arranged at two or more levels in a laminated construction, that define a matrix array of charge-generating sites from which charge carriers are directed at an imaging member.

In an image forming system employing a charge emitting printhead, a charge latent image is comprised of charge carriers deposited on the surface of an imaging member. The imaging member moves along a process direction past a printhead, which produces a stream of charge carriers, such as electrons, from an array of charge-generating sites. The electrons are accelerated towards the imaging member in image configuration to create the latent charge image on the imaging member. The charge latent image receives a developer material, to develop the image, and the image is subsequently transferred and fused to a support sheet, such as paper, to form a printed document.

A charge emitting printhead generally includes a layer of long drive electrodes (e.g. RF-line electrodes), oriented in a first direction perpendicular to the process direction, and spanning a page width, and a layer of control electrodes (e.g. finger electrodes) oriented transversely to the drive electrodes to form spatially separated crossing points or intersections with the drive electrodes. A dielectric layer couples to, and physically and electrically separates and insulates, the drive electrodes from the control electrodes. The crossing points form charge-generating sites, which generate and direct toward the imaging member a collection of charge carriers that comprise the latent image. The drive electrodes are activated with an RF signal of up to several thousand volts amplitude while lesser bias or control voltages are applied to the control electrodes to switch between an ON and OFF emission of one polarity particles from the particular sites. The activation of the drive electrodes and the control electrodes creates localized charge source regions located at or near the crossing points of the drive electrodes and the control electrodes (the charge-generating sites) and allows charge carriers to escape from the glow or discharge regions and be accelerated to the imaging member. These printheads may be configured to deposit either positive or negative charge, and the negative charge may consist partly or entirely of either ions or electrons. Charge deposited by each charge emitting locus forms a small dot-like latent charge image on the imaging member as it moves past. Each raster scan of the printhead electrodes thus fills a narrow rectangular image strip, with the totality of image strips forming an image page.

In image forming systems using this type of printhead, the RF-driven electrodes extend generally along the width of the printhead in a cross-scan direction (i.e. perpendicular to the direction in which the imaging member moves), spanning many of the control electrodes which cross them at an angle. In one commercial embodiment, by way of example, twenty parallel RF lines extend the width of a print page, and are crossed by 128 oblique finger electrodes. During the time when one RF line is activated by a burst of approximately 5 to 25 cycles of a one-half to fifty MHz drive signal with a peak-to-peak amplitude of several thousand volts, the finger electrodes which cross the RF line electrodes at the desired dot locations are selectively biased to project charge dots from the printhead onto the imaging member. Each finger electrode effectively drives up to twenty charge emitting sites arranged along its length and corresponding to the twenty adjacent RF drive electrodes. By sequential activation of drive lines, the crossing sites of the same finger electrode are energized at slightly different times as the imaging member passes the printhead. In this manner, the finger electrode may deposit dots closely adjacent to each other on a single print line.

In an image forming system using the described printhead, a charge latent image is created line by line as an imaging member scans past the printhead. Each line extends the width of a print sheet, and is comprised of charge dots deposited in a fixed time sequence utilizing all of the charge-generating sites. Each charge-generating site corresponds to a specific pixel position along a cross-scan line in the image and is configured to place a charge dot at that particular location when activated. To create each line of the charge latent image on the imaging member, the drive electrodes are successively activated with a regular and fixed order as the imaging member scans past each electrode in the printhead. Thus, each line of the latent image is formed with the same dot deposition pattern as all preceding and all subsequent lines in the image.

The type of printheads discussed above are generally operated at a relatively small gap of about one-quarter millimeter from the imaging member, and are biased with respect to the imaging member to maintain a relatively high electric field which transports the charged particles across this gap. Generally, the amount of charge or charged particles which must be deposited to form an effective imaging dot is generally so great as to result in a considerable build-up of charge at the dot locus on the charge-receiving surface of the imaging member, relative to the magnitude of the acceleration potential. Thus, as a latent dot charge is formed, a local electric field develops which tends to deflect later arriving charge carriers directed at or near that dot. This effect may result in "blooming" or enlargement of individual dots, such as described in the aforesaid U.S. Pat. Nos. 5,278,588 and 5,886,723, the contents of which are herein incorporated by reference, and various approaches are taught therein for addressing the precision of dot placement and image control to overcome deleterious the effect of dot blooming on image resolution. Surface charging effect may also slightly deflect nearby dots. This effect occurs when electrodes are actuated to lay down a latent charge dot on the imaging member at a position closely adjacent to or between one or more charge dots which have already been deposited along a line or region. In this case, the already deposited charge deflects the incoming charge carriers so that the subsequent dot is shifted laterally. Since the RF lines are few in number and are actuated in a generally fixed successive sequence, a vertical banding effect, known as "Venetian blinding" occurs. As each line of the image is formed with the same sequence of dot deposition, irregularities and defects are repeated at an equivalent location on every line of the image, generating a ripple or line of misplaced dots that appear as a streak or an anomalously light or dark band periodically crossing the face of the print. This banding effect tends to highlight and magnify even small defects in the image.

Despite the apparently high degree of uniformity of existing charge emitting printheads, a number of macroscopically visible irregularities are produced in the images which they deposit. These irregularities are repeated and magnified in every line of the image, creating a banding effect.

SUMMARY OF THE INVENTION

The present invention provides a printhead wherein a matrix array of charge-generating sites is defined by the crossing points of a first set of electrodes, such as drive electrodes, and a second set of electrodes, such as finger electrodes. Electrodes of the first set are parallel to each other and extend across the region to be printed, while electrodes of the second set are also parallel to each other, but extend obliquely across the first electrodes in a plane parallel thereto to define the crossing points. The crossing points of the first and second electrodes are closely spaced lattice points at which charge carriers are generated for projection onto a latent imaging member such that charge dots are uniformly deposited. In the matrix array of charge-generating sites, the rows of the matrix array are defined by the first set of electrodes, and the columns are defined by the second set of electrodes.

The printhead of the present invention includes a set of redundant drive electrodes forming in the matrix array. According to one practice, the set of redundant electrodes is formed by providing additional, surplus rows of the first set of electrodes, and modifying or adding to the second set of electrodes such that each redundant electrode repeats the charge-deposition pattern of another electrode in the matrix array. The redundant electrodes are selectively activated in place of the corresponding primary electrodes. This allows variation of the charge deposition sequence from line to line when forming a latent image.

Using a variety of sequence orders for depositing charge visually suppresses vertical banding effects in the final output image. The level of reduction of vertical banding corresponds to the number of redundant rows in the matrix array. As a result, image quality is significantly improved.

BRIEF DESCRIPTION OF THE DRAWINGS

These and other features of the invention will be understood from the description herein and the claims appended hereto, read in light of the art and with the benefit of illustrative drawings, wherein

DETAILED DESCRIPTION OF THE INVENTION

According to illustrative embodiments of the present invention, a printhead for providing a variable sequence of charge dots is described. The illustrative embodiment will be described below relative to an implementation in an image forming system. Those skilled in the art will appreciate that the present invention may be implemented in a wide variety of machines or image forming systems and is not specifically limited in its application to the particular embodiment depicted herein. The term image forming system, as used herein, is intended to include a collection of different technologies, such as electron beam imaging, electrophotographic, electrostatic, electrostatographic, ionographic, acoustic, inkjet and other types of image forming or reproducing systems adapted to capture, store, form, produce and/or reproduce image data associated with a particular object, such as a document.

Figure 1:
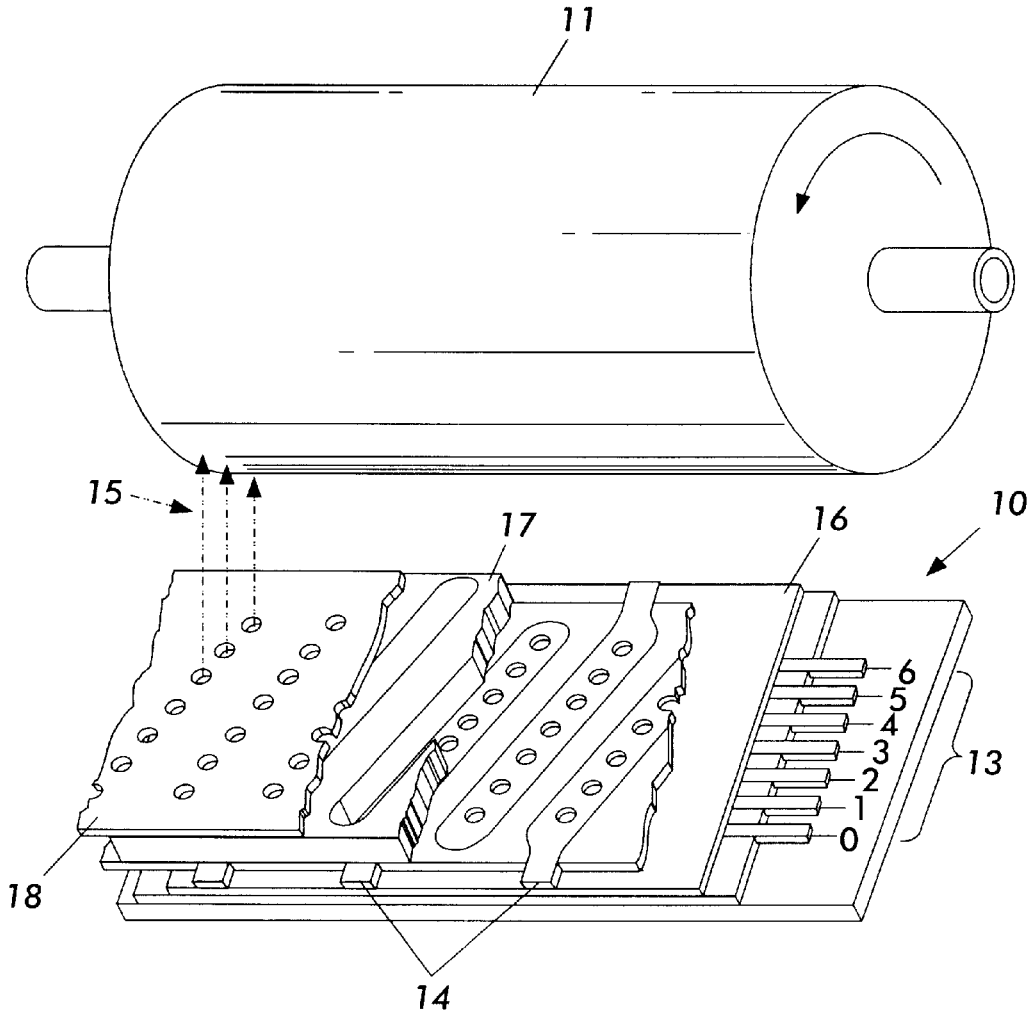
FIG. 1 PRIOR ART
FIG. 1 illustrates a conventional charge deposition printhead in an image forming system.

FIG. 1 illustrates a conventional charge deposition printhead 10 in an image forming system which, as shown, is spaced opposite an imaging member, shown as imaging drum 11, and projects charged particles 15 onto the drum surface. As illustrated, the printhead 10 has a first electrode layer comprising a plurality of RF drive line electrodes 13 which are crossed by finger electrodes 14 forming a second electrode layer. A controller (not shown) is in electrical communication with the printhead 10 for directing the printhead 10 to transfer a charge image onto the imaging drum 11. To generate and emit charged particles from the printhead, a high rf-voltage is applied to drive lines 13, while a dc-voltage of a given polarity is applied to the finger electrodes 14 and the screen electrode 18. Charged generation occurs at each point where a drive line 13 and a finger electrode 14 cross and form a charge-generating site. A dielectric layer 16 separates and insulates the two electrode layers. A spacer plate 17 separates the finger electrodes 14 and screen electrode 18, and includes a number of cavities with shapes that conform to the electrodes.

For clarity of presentation, the gap between the printhead 10 and the imaging drum 11 is greatly exaggerated, as is the curvature of the drum. Also, the RF or drive electrodes are numbered in order from 0 to 6. If the imaging member is curved, then the RF line or lines closest to "top dead center" of the imaging member (the "central electrodes") are closest to the imaging member, while RF lines adjacent thereto and outward from the center (the "edge electrodes") are further away from the imaging surface due to the curvature of the imaging surface. The increased gap results in lower electric field strengths, with the result that less charge is emitted and deposited from the edge electrodes. The periodic actuation of RF drive electrodes and scanning of the drum past the printhead therefore creates a pattern of "weak" and "strong" charge dots which can also give macroscopically-visible banding or texture to the developed charge image. The printhead 10 is mounted parallel to the axis of drum 11 and tangent to its surface at a spacing of about 0.25 mm, so that the central electrode—RF-line 3—is in practice closest to the drum, while the edge electrodes—RF-line 0, RF-line 1, RF-line 5 and RF-line 6—deposit progressively less charge. It will be understood that the properties of "weak" and "strong" dots relate to the charge magnitude, which is a function in part of the printhead alignment and positioning over a curved drum or imaging surface.

Each line in a latent image formed by the printhead 10 of FIG. 1 comprises charge dots deposited in a time sequence from the charge-generating sites as the imaging member scans past the printhead. Conventionally, the RF drive electrodes 13 are swept in a regular order, e.g., the high voltage RF signal is applied to them in the order 0. 1. 2. 3. 4. 5. and 6, while the finger electrodes 14 are selectively biased to project charge dots from the printhead 10 at the pixels where a print image is to be formed. Thus, all charge-generating sites formed by RF-line #0 deposit charge first, followed by charge-generating sites formed by RF-line#1, which deposits a second set of charge adjacent to the first set of charge. Next, RF-line#2 deposits a third set of charge adjacent to the second set of charge, and so on until RF-line #6 deposits the last set of charge. This activation order is repeated for each line formed in the image.

Figure 2:
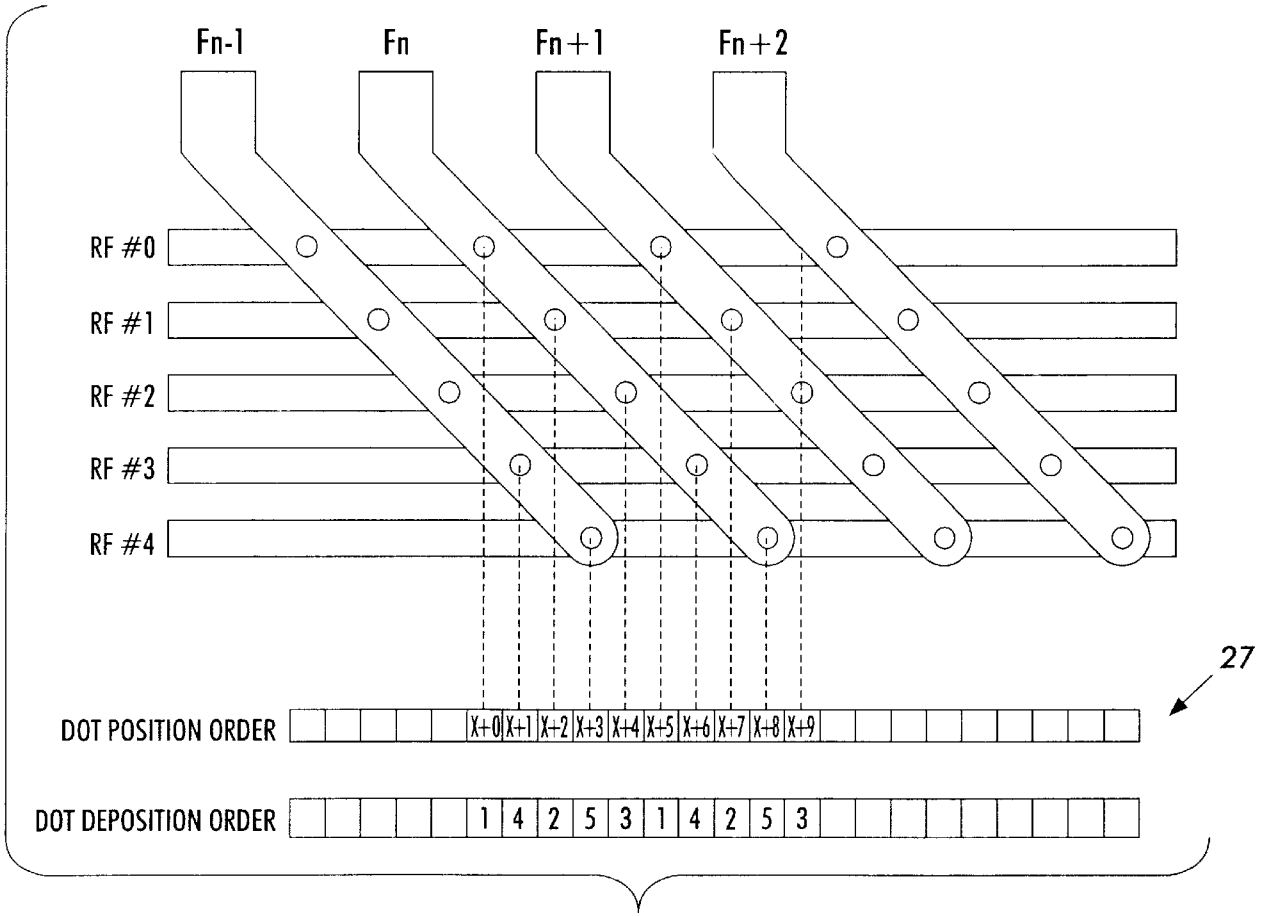
FIG. 2 PRIOR ART
FIG. 2 is a schematic view of a segment of a matrix array of charge-generating sites for an alternative conventional printhead.

FIG. 2 is a schematic view of another conventional printhead, illustrated as a segment of a matrix array of charge-generating sites and a corresponding time order of deposited charge dots for a single horizontal line. In the printhead segment of FIG. 2, the charge-generating sites in the matrix array are formed by crossing finger control electrodes Fn−1, Fn, Fn+1, and Fn+2, with RF-line drive electrodes RF#0, RF#1, RF#2, RF#3 and RF#4. Each charge-generating site in the printhead, located at electrode crossings, is configured to deposit a charge dot at a specific pixel location along a horizontal line 27. This relationship is represented by the dotted lines in FIG. 2. For example, the charge-generating site at the crossing-point between finger electrode Fn and RF#0 corresponds to the pixel location X+0 and the charge-generating site forming at the crossing point between finger electron Fn−1 and RF#4 corresponds to pixel position X+3 along the horizontal line 27.

When activated, each charge-generating site deposits charge at the corresponding pixel position as the imaging member scans past the printhead. As the portion of the imaging member including the horizontal line 27 moves opposite each RF-line successively, the RF-lines are triggered in a successive order to deposit charge. Thus, a raster scan of the RF-line electrodes fills a line of charge on the imaging member as it moves past. For example, as the imaging member scans past the printhead, the first charge dots of the line 27 (having dot deposition order 1) are emitted from the charge-generating sites located on RF#0 and deposited at each respective pixel position. The next set of charge dots (having dot deposition order 2) is generated by energizing RF#1 and deposited at each respective corresponding pixel position. Then, the third set of charge dots (having dot deposition order 3) is deposited from the charge-generating sites of RF#2, followed by the fourth set of charge dots (having dot deposition order 4) generated by the charge-generating sites of RF#3. Finally, the charge-generating sites of RF#4 generate and deposit a fifth and final set of charge dots (having dot deposition order 5) between the second and third sets of charge to complete the line 27. Thus, by sequential trigger of the drive lines from RF#0 to RF#4, the whole line 27 is created by a periodically repeated sequence of dots in the order 1, 4, 2, 5, 3. The order in which a charge dot is deposited at a pixel location is recorded below each pixel position of line 27. The same activation order of the RF-lines and the same deposition order of the charge dots are repeated for all lines in the image.

The printhead of FIG. 2 is designed to interleave strong dots and weak dots by depositing charge on the imaging member in an alternating order. Dots deposited by edge electrodes RF#0 and RF#4, which have relatively weaker charges, are interleaved with dots deposited by the central electrodes RF#1, RF#2 and RF#3, which deposit relatively stronger charge dots. While this configuration somewhat improves irregularities and discontinuities by forming a more uniform line of charge on an imaging member, certain defects persist. As discussed, each line in the image is formed with the same order of dot deposition, by sweeping the RF drive lines with a regular and consistent sequence, beginning with RF#0. This systematic deposition of charge results in a banding effect, where even small irregularities are magnified in the final image.

Due to interactions between the electron beams and already deposited charges, there basically are three "different" categories of charge dots formed on an imaging member. The first category includes dots deposited on "plain" dielectric (no neighboring charge in the line at the time of printing), the second category includes dots deposited beside already charged places, and the third category includes dots placed between two charges areas. Individual dots show different sizes and different charge density distributions. As the dot properties, including size and density, depend on the order in which the dot is deposited on the imaging member, all variations and blooming effects occur at the same location in each line of the image. Because the character of dots is determined by the time sequencing, their relative position in the horizontal line is constant, and therefore the dots are all horizontally registered with similar dots in preceding and subsequent lines. For example, all "strong" dots are aligned in every line of the image, and all "weak" dots are aligned. This dot alignment causes vertical banding effects in the image. As each line in the image repeats an irregularity at the same location, such as a dot misalignment or an uneven charge, a streak occurs which tends to highlight and emphasize the irregularity.

Figure 3:
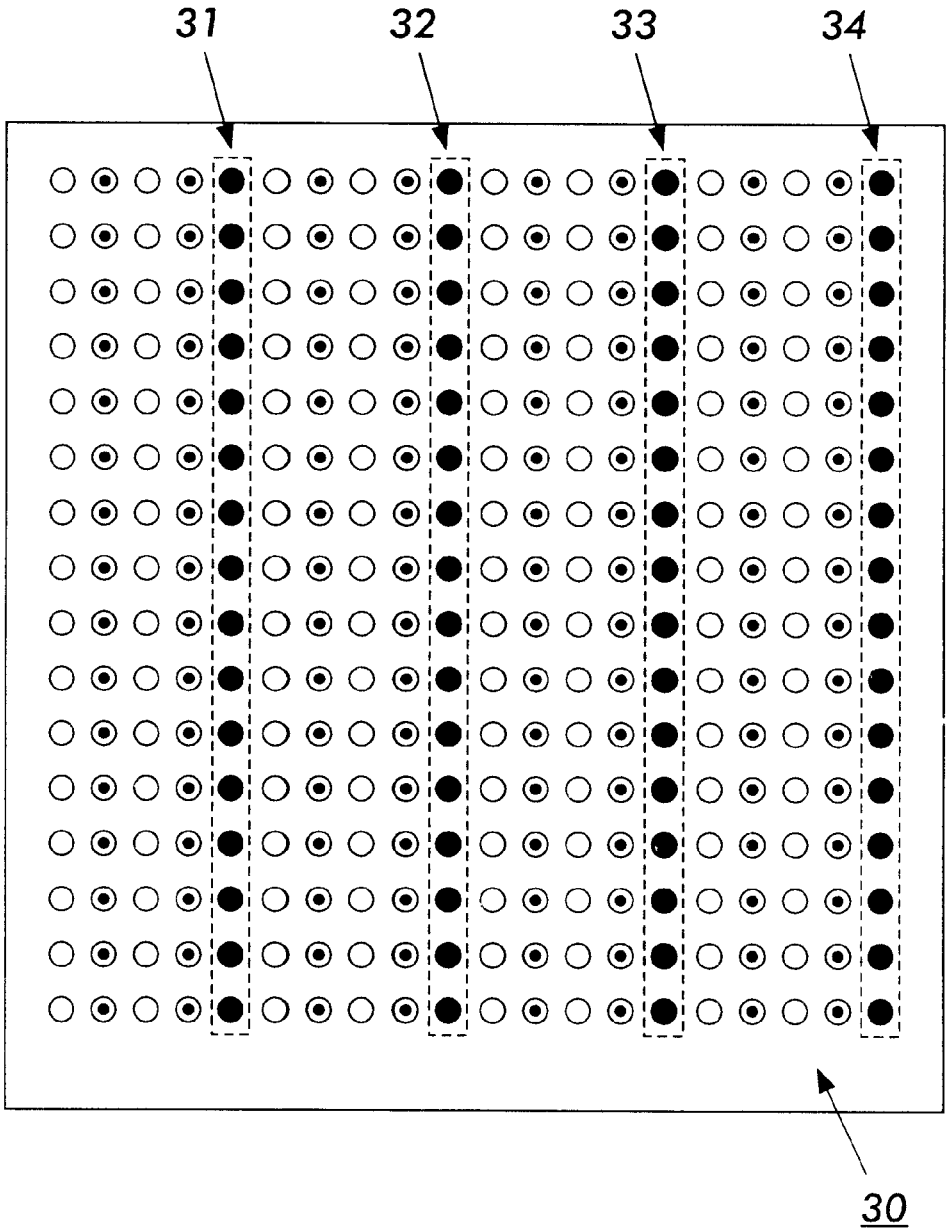
FIG. 3 PRIOR ART
FIG. 3 illustrates a dot distribution pattern generated by the printhead of FIG. 2.

FIG. 3 represents an example of a dot distribution pattern in an image formed by a standard printhead with five drive lines, as illustrated in FIG. 2. As shown, a fixed order of dot deposition results in a vertical alignment of irregularities and like dots in an image 30. Each line has the same dot distribution pattern, which lead to vertical banding effects, particularly evident at the vertical lines 31, 32, 33 and 34.

Figure 4:
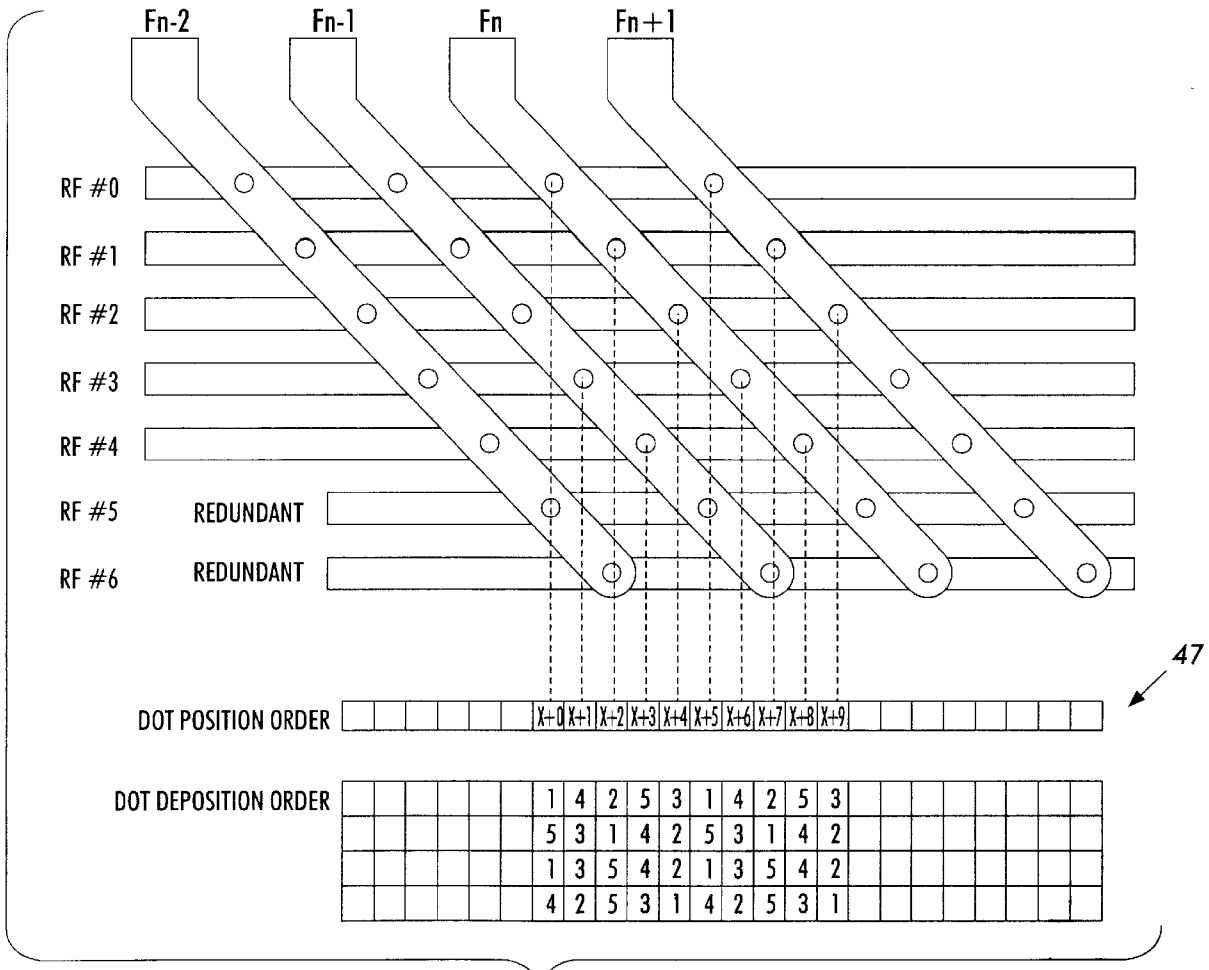
FIG. 4 is a schematic view of a segment of a matrix array of charge-generating sites, including a set of redundant rows of electrodes for a printhead of the present invention.

FIG. 4 schematically illustrates a segment of a matrix array of charge-generating sites according to one practice of the present invention. The printhead schematically illustrated in FIG. 4 suppresses the banding effect that occurs with the printheads of FIGS. 1 and 2 by adding one or more redundant drive electrodes (shown as RF#5 and RF#6). The rows of the matrix array of charge-generating sites are defined by RF drive line electrodes RF#0, RF#1, RF#2, RF#3, RF#4, RF#5 and RF#6, and the columns are defined by finger electrodes Fn−2, Fn−1, Fn, and Fn+1, or another set of control electrodes. The printhead comprises a primary set of RF-electrodes (RF#0, RF#1, RF#2, RF#3, RF#4) extending in a cross-scan direction and forming charge-generating sites similar in form to the charge-generating sites of the printhead illustrated in FIG. 2, and a redundant set of RF-electrodes (RF#5, RF#6). The term "cross-scan" denotes that the electrodes extend in a direction perpendicular to the process or scan direction of the imaging member. The term "primary set" refers to a set of electrodes forming a matrix array of charge-generating sites that is sufficient to form an image. In the primary set, each row of charge-generating sites forms a different and distinct charge-generating pattern from all other rows in the primary set and deposits dots which are distinct. Primary electrodes correspond to a conventional printhead configuration, such as the printheads illustrated in FIGS. 1 and 2. The term "redundant" or "redundant electrodes" means that the RF-electrodes are supplied to the printhead in addition to the primary set of RF-electrodes, and that the RF-electrodes form a substantially identical pattern of charge-generating sites to one or more of the RF-electrodes (a matching electrode). The redundant RF-electrodes and charge-generating sites are surplus and may substitute for a matching primary electrode to create a charge latent image.

When activated, a redundant RF-electrode deposits an identical charge pattern on the imaging member as a matching RF-electrode. In the printhead of FIG. 4, redundant electrode lines are added to an otherwise standard printhead. In this case, redundant electrodes RF#5 and RF#6 repeat the charge-emitting patterns of RF#0 and RF#1. Thus, an individual charge dot formed on the imaging member can be printed from a plurality of charge-generating sites. For example, charge dots in a charge latent image that are generated from a charge-generating sites formed by RF#0 can also be generated from a charge-generating sites formed by RF#5. As shown in FIG. 4, line pixels X+0 and X+5 along a horizontal line 47 correspond to and can be formed by the charge-generating sites of both RF#0 and RF#5. Similarly, the charge-generating sites of both RF#1 and RF#6 correspond to the pixel positions X+2 and X+7 along the horizontal line 47.

The printhead of FIG. 4 allows for a variable dot deposition order. The order in which dots are deposited can be varied from line to line in the charge latent image with use of the redundant electrodes. For example, a first line of a charge latent image may be formed by activating a primary set of electrodes to generate and deposit charge. However, an adjacent line may be formed by activating one or more redundant electrode in place of a matching primary electrode (e.g. a primary electrode forming the same pattern of charge-generating sites as a given redundant electrode). A strong charge dot in a first line of the image could be placed first on the imaging member while a charge dot in an analogous position on an adjacent line may be deposited in a different order in the time sequence, and therefore have different properties than the first dot.

Figure 5:
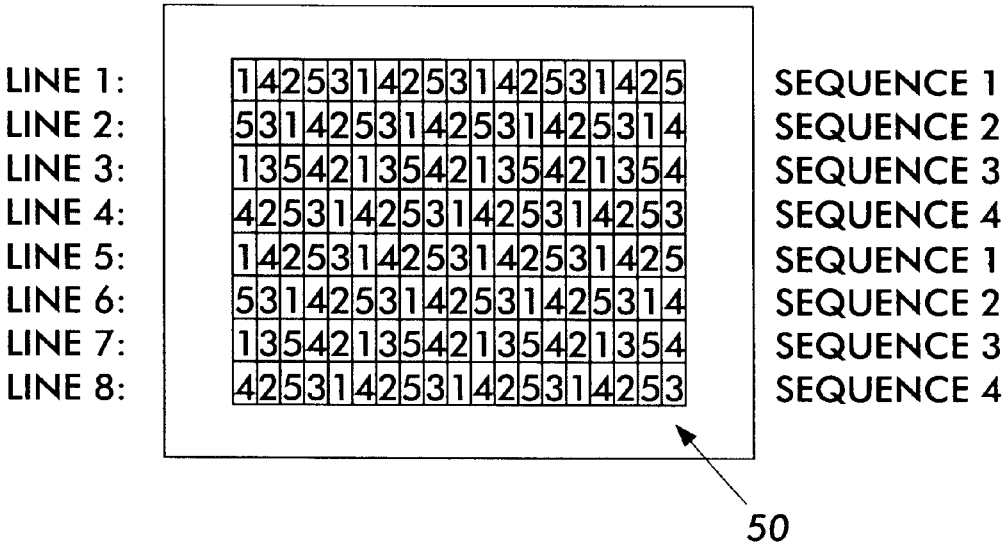
FIG. 5 illustrates a dot deposition order for a charge latent image comprised of eight lines formed by a printhead of the present invention.

FIG. 5 illustrates a dot deposition order for a series of lines in a charge latent image for a printhead of the present invention. The image 50 includes eight lines created with a printhead having redundant electrodes, as illustrated in FIG. 4. The numbers in each line indicate the order in which charge is deposited on the line at the respective pixel position. When using a printhead with two redundant rows of RF-electrodes, such as the printhead illustrated in FIG. 4, three additional sequences may be selected to create a substantially identical charge pattern. A first line, or other charge pattern, in the image 50 is created by activating the RF-electrodes using the RF-electrode sequence RF#0, RF#1, RF#2, RF#3, RF#4 ("Sequence 1"). This is the same sequence used in a conventional printhead, as described with respect to FIG. 2. Sequence 1 is used to form line 1 and line 5 of the image 50.

In an alternate RF-electrode sequence, redundant electrode RF#5 is activated to deposit dots in place of electrode RF#0. As RF#5 repeats the dot deposition pattern of RF#0, this sequence deposits dots in the same configuration as the first sequence, but at a different point in the activation order. When activating the RF-lines, the controller for the printhead "skips over" electrode RF#0, and activates redundant electrode RF#5 instead. In this case, the RF-electrode sequence is: RF#1, RF#2, RF#3, RF#4, RF#5 ("Sequence 2"). Sequence 2 is used to form line 2 and line 6 of the image 50.

In a third possible RF-electrode sequence, redundant electrode RF#6 replaces electrode RF#1, forming an RF-electrode sequence of: RF#0, RF#2, RF#3, RF#4, RF#6 "Sequence 3"). Sequence 3 is used to form line 3 and line 7 of the image 50.

In a fourth RF-electrode sequence, redundant electrodes RF#5 and RF#6 replace electrodes RF#0 and RF#1, respectively. In this case, the activation sequence for depositing charge dots is: RF#2, RF#3, RF#4, RF#5, RF#6 ("Sequence 4"). Sequence 4 used to form line 4 and line 8 of the image 50.

All RF-electrode sequences, while utilizing different electrode and charge-generating site combinations, print a substantially identical end result. However, the dot order, and thus the individual dot properties are varied from line to line. Thus, a first path or line of charge in an image is deposited according to a first sequence of charge-generating sites, such as Sequence 1, while an adjacent path or line of charge in the image is deposited according to a different sequence of charge-generating sites, such as Sequence 2.

Figure 6:
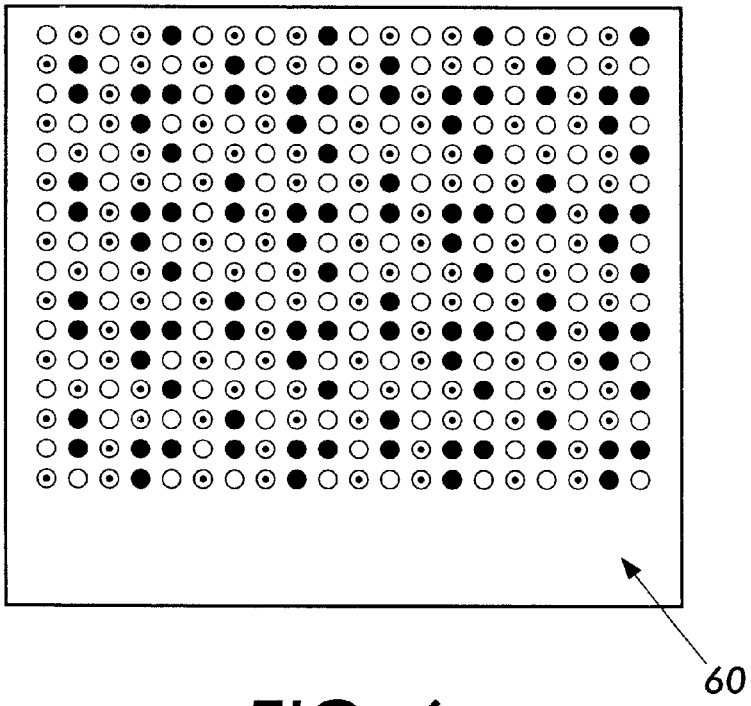
FIG. 6 illustrates a randomized dot distribution pattern generated by a printhead of the present invention.

The possibility of using different line sequences allows for variation of the charge dot printing from line to line in the image. This variation is represented in FIG. 6, where dot properties appear more randomized from line to line in the image 60. As discussed, the dot properties depend upon the deposition order, and when the deposition order is repeated for every line, irregularities also are repeated, resulting in a banding effect. However, a variation in the activation order of the electrodes, and thus the dot deposition order, suppresses the vertical banding effect. Variation of the deposition order randomizes dot appearance and the properties of dots in analogous positions on different lines of the image. This variation removes or eliminates the streaking effect that occurs when each line in the image is printed with a fixed order of dot deposition. As such, a strong charge dot is not always placed next to a strong charge dot in an adjacent line, and a weak charge dot is not always placed next to a weak charge dot in an adjacent line. Not only does the present invention provide a more uniform line of charge on an imaging member, the printhead of the present invention provides a more uniform charge throughout the entire image. As a result, irregularities are less visible in the final image. As shown, each line printed by the printhead of the present invention breaks up and visually suppresses vertical banding effects. FIG. 6, formed by a printhead of the present invention, can be compared to FIG. 3, formed by a conventional printhead, to demonstrate the improvements to the dot distribution pattern by varying the activation sequence and dot deposition order from line to line in the image.

The number of possible charge-deposition sequences, and thus the level of banding suppression, increases with the number of redundant electrode lines. The number of different charge-deposition sequences that may be activated by a printhead equals $2^N$, where N is equal to the number of redundant electrodes. For example, when there are no redundant electrodes, the number of charge-deposition sequences is limited to 1. With no redundant electrodes, the charge-deposition sequence is limited to activation of the drive electrodes in a fixed successive order. When two redundant electrodes are added to the printhead, as illustrated in FIG. 4, there are four possible sequences to choose from. Each sequence is implemented by selectively activating one or more redundant RF-line electrodes in place of one or more corresponding primary RF-line electrodes, or by activating all primary electrodes without utilizing any redundant electrodes.

Any number of redundant electrodes may be used to provide a variety of charge-deposition sequences in order to reduce vertical banding effects and improve image quality. According to one practice of the present invention, which is not to be construed in a limiting sense, up to 60% of the primary RF-lines comprising a conventional printhead are repeated (e.g. employ redundant electrodes). For example, if a printhead configuration contains twenty primary RF-line (drive) electrodes to create an image, up to twelve additional redundant electrode lines are employed, for a total of thirty-two RF-line electrodes. To create a variable charge deposition order, the redundant electrodes are selectively activated in place of the matching primary electrode or electrodes forming a substantially identical charge-generating pattern.

In a printhead having twelve redundant rows of electrodes, there are up to 4096 ($2^{12}$) possible printing sequences. Thus, a duplication of up to 60% of the primary electrodes significantly reduces vertical banding effects and improves image quality.

Furthermore, repetition of an edge RF-line electrode, rather than a central RF-line electrode, tends to be more beneficial in reducing vertical banding effects. It is particularly advantageous to provide a redundant electrode for a drive electrode that is normally at the beginning of the activation order. The edge electrodes tend to produce greater irregularities, due to a greater distance between the electrode and the imaging member. While repetition of a central electrode still provides some benefit, the result is not as apparent.

The activation order of the electrodes can be preprogrammed into the printhead and controlled by the controller. The sequences can be activated according to any order, and are not necessarily repeated in a regular order. For example, in FIG. 5, the printhead first prints with sequence#1, followed by sequence#2, sequence#3, and finally sequence#4. This order is again repeated for the next four lines, and for all subsequent lines in the image. However, the activation order can be programmed randomly such that no apparent order exists in executing the possible printing sequences. For example, ten lines in an image can be formed with the following combination of sequences:

Line 1: sequence 1 (RF#0, RF#1, RF#2, RF#3, RF#4)
Line 2: sequence 2 (RF#1, RF#2, RF#3, RF#4, RF#5)
Line 3: sequence 4 (RF#2, RF#3, RF#4, RF#5, RF#6)
Line 4: sequence 3 (RF#0, RF#2, RF#3, RF#4, RF#6)
Line 5: sequence 1 (RF#0, RF#1, RF#2, RF#3, RF#4)
Line 6: sequence 4 (RF#2, RF#3, RF#4, RF#5, RF#6)
Line 7: sequence 3 (RF#0, RF#2, RF#3, RF#4, RF#6)
Line 8: sequence 2 (RF#1, RF#2, RF#3, RF#4, RF#5)
Line 9: sequence 4 (RF#2, RF#3, RF#4, RF#5, RF#6)
Line 10: sequence 1 (RF#0, RF#1, RF#2, RF#3, RF#4)

According to an alternate practice of the present invention, the printhead can be configured to include a "horizontal" randomization in addition to the "vertical" randomization described above. Using a horizontal randomization, each individual printed line is broken into a set of segments. The length of the individual segment can be uniform or variable, where a variable length can be either predetermined or randomly chosen. Each segment is then printed with a varied dot deposition sequences as described above. The order of the sequences can be predetermined or randomly chosen. For example, eight lines of an image can be formed with the following combination of sequences:

Line 1: [ . . . sequence 1 . . . ][ . . . sequence 4 . . . ][ . . . sequence 2 . . . ]
Line 2: [ . . . sequence 2 . . . ][ . . . sequence 1 . . . ][ . . . sequence 3 . . . ]
Line 3: [ . . . sequence 4 . . . ][ . . . sequence 3 . . . ][ . . . sequence 2 . . . ]
Line 4: [ . . . sequence 3 . . . ][ . . . sequence 4 . . . ][ . . . sequence 3 . . . ]
Line 5: [ . . . sequence 1 . . . ][ . . . sequence 2 . . . ][ . . . sequence 4 . . . ]
Line 6: [ . . . sequence 4 . . . ][ . . . sequence 3 . . . ][ . . . sequence 2 . . . ]
Line 7: [ . . . sequence 3 . . . ][ . . . sequence 2 . . . ][ . . . sequence 1 . . . ]
Line 8: [ . . . sequence 2 . . . ][ . . . sequence 1 . . . ][ . . . sequence 4 . . . ]

There are a practically unlimited number of combinations for forming an image.

The present invention is implemented in combination with prior improvements to printheads, such as the printhead of FIG. 2 wherein strong dots and weak dots are interleaved on each line of the image. As a result, the print quality of an image is significantly improved. The present invention provides a simple solution to the problem of vertical and other banding effects in an image forming process. By utilizing a printhead of the present invention, streaking effects in the image are broken up, and irregularities are diminished and reduced. Thus, the print quality of the final image is significantly improved.

The invention contemplates a method of depositing charge dots of uniform magnitude from a matrix array of crossing points of first and second electrodes, by providing a variable order of dot deposition. However, it will be understood by those skilled in the art that various constructions and techniques may be used. What is important is that the matrix of electrodes are arranged to reduce banding effects, and that this is achieved with a printhead having redundant charge-generating sites for forming an image. The invention being thus disclosed and described, further variations and modifications will occur to those skilled in the art and all such variations and modifications together with their equivalents are intended to be within the spirit and scope of the invention, as described herein and defined by the claims appended hereto.

What is claimed is:

1. In an image forming system, a printhead for generating a charge image on an imaging member, the printhead comprising:

a plurality of first electrodes extending parallel to each other in a cross-scan direction; and a plurality of second electrodes separated from said first electrodes by a separating layer and extending substantially parallel to each other in a direction transverse to said first electrodes to define a lattice array of charge-generating sites where said first and second electrodes overlap;

wherein the plurality of first electrodes includes at least one redundant electrode, said redundant electrode forming a substantially identical pattern of charge-generating sites as another corresponding one of said plurality of first electrodes.

2. The printhead of claim 1, wherein said separating layer comprises a dielectric layer formed of a dielectric material.

3. The printhead of claim 1, wherein the redundant electrode is selectively activated in place of another corresponding first electrode when generating the charge image.

4. The printhead of claim 3, wherein selective activation of the plurality of first electrodes produces a variable activation sequence for generating and depositing charge on an imaging member.

5. The printhead of claim 1, further comprising a controller for activating one of said plurality of first and second electrodes according to a variable sequence.

6. The printhead of claim 1, wherein the plurality of first electrodes comprises a plurality of drive electrodes, and the plurality of second electrodes comprises a plurality of finger electrodes.

7. A method of constructing a printhead for forming a charge latent image on an imaging member, said method comprising the steps of separating a plurality of first electrodes extending substantially parallel to each other from a plurality of second electrodes extending substantially parallel to each other in a direction transverse to said first electrodes, said plurality of first and second electrodes defining an array of charge-generating sites where said first electrodes and said second electrodes overlap; and forming with at least one of said plurality of first electrodes a substantially identical pattern of charge-generating sites as another one of said plurality of first electrodes.

8. The method of claim 7, further comprising the step of separating said plurality of first and second electrodes with a dielectric material.

9. The method of claim 7, further comprising the step of producing with the plurality of first electrodes a variable activation sequence for generating and depositing charge on an imaging member.

10. A method of creating a charge image on an imaging member comprising:

depositing charge along a first path on a surface of the imaging member according to a first sequence of charge-generating sites formed by a plurality of first electrodes and a plurality of second electrodes; and depositing charge along a second path on the surface of the imaging member according to a second sequence of charge-generating sites that is different from said first sequence, wherein the plurality of first electrodes includes at least one redundant electrode, the redundant electrode forming a substantially identical pattern of charge generating sites as another corresponding one of the plurality of first electrodes.

11. The method of claim 10, further comprising the step of interspersing strong charge dots with weak charge dots along the first path.

12. The method of claim 11, further comprising the step of interspersing strong charge dots with weak charge dots along the second path.

13. The method of claim 10, wherein the first path is a first line extending in a cross-scan direction on the imaging member.

14. The method of claim 13, wherein the second path is a second line extending in a cross-scan direction and adjacent to said first line.

15. The method of claim 14, wherein the charge image is comprised of a plurality of lines of charge deposited on the imaging member according to a predetermined sequence.

16. The method of claim 15, wherein the predetermined sequence is varied from line to line in the image.

17. The method of claim 16, wherein at least one line of the charge image is comprised of a plurality of segments, wherein a first segment of the line is printed with a first sequence of charge-generating sites and a second segment is printed with a second, different sequence of charge-generating sites.

18. An image forming system for forming a charge latent image on an imaging member comprising a printhead defined by a matrix array of charge-generating sites; and a controller for selectively activating the charge-generating sites according to a variable sequence to form a charge latent image on the surface of the imaging member, wherein the matrix array of charge-generating sites in the printhead includes at least one row of charge-generating sites that repeats a charge-generating pattern of another row in the matrix array.

19. The image forming system of claim 18, wherein the charge latent image is comprised of a plurality of lines of charge dots.

* * * * *